US005904269A

United States Patent [19]

Wolff

[11] Patent Number: 5,904,269

[45] **Date of Patent: *May 18, 1999**

[54] STORAGE CONTAINER

[75] Inventor: Stacy L. Wolff, Houston, Tex.

[73] Assignee: Rubbermaid Incorporated, Wooster, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/688,374

[22] Filed: Jul. 30, 1996

[51] Int. Cl.[6] ..... B65D 25/28

[52] U.S. Cl. ..... 220/756; 220/770

[58] Field of Search ..... 220/770, 756, 220/771, 318; D34/7

[56] References Cited

U.S. PATENT DOCUMENTS

| | | | |
|---|---|---|---|
| D. 323,914 | 2/1992 | Doxey et al. | 220/908 |
| D. 326,342 | 5/1992 | Doxey et al. | 220/908 |
| D. 355,118 | 2/1995 | Dickinson et al. | D9/425 |
| D. 358,765 | 5/1995 | Dickinson et al. | D9/425 |
| D. 361,511 | 8/1995 | Dickinson et al. | D9/425 |
| 1,666,012 | 4/1928 | Humphrey | 220/756 |
| 1,698,929 | 1/1929 | Wentorf | 220/756 |
| 2,081,925 | 6/1937 | Graf | 220/756 |
| 3,185,342 | 5/1965 | Gottsegen et al. | 220/770 |
| 3,960,289 | 6/1976 | Panicci | 220/756 |
| 4,592,482 | 6/1986 | Seager | 220/756 |
| 4,696,412 | 9/1987 | McGowan et al. | 220/335 |
| 4,819,827 | 4/1989 | DiSesa | 220/318 |
| 5,011,013 | 4/1991 | Meisner et al. | 206/373 |
| 5,125,697 | 6/1992 | Kahl et al. | 292/204 |
| 5,202,098 | 4/1993 | Nichols | 422/300 |

FOREIGN PATENT DOCUMENTS

| | | | |
|---|---|---|---|
| 835341 | 3/1952 | Germany | 220/756 |

OTHER PUBLICATIONS

P. 10, Storage containers: Contico Manfacturing Company, 1101 Warson Road, St. Louis, Missouri 63132. Publication date 1991–92.

*Primary Examiner*—Joseph M. Moy
*Attorney, Agent, or Firm*—Richard B. O'Planick; Timothy A. Nathan

[57] ABSTRACT

A container and lid assembly includes a container, lid and handle members for carrying and securing together the handle and lid, and the lid has recesses oriented in the top wall of the lid such that a user's hand is received in the recess when a user is grasping one of the handles.

16 Claims, 8 Drawing Sheets

STORAGE CONTAINER

TECHNICAL FIELD

This invention relates to a container and lid assembly having a handle member which may be used to selectively secure together the container and lid.

BACKGROUND ART

Most container and lid assemblies include a container and lid having a separate handle member secured to the container and a separate locking member secured to the container which may be used to secure together the container and lid. While a few container and lid assemblies do contain a latch which also serves as a handle member, there are some disadvantages with these assemblies. Specifically, some of the latch and handle assemblies such as the assembly illustrated in U.S. Pat. No. 3,416,701 consist of numerous components which must be separately manufactured, assembled and secured to the container. In addition, other handle and latch assemblies such as the one illustrated in U.S. Pat. No. 3,741,433 includes a handle molded into the product which only allows a minimal amount of weight to be carried in the container. Finally, other latch and handle assemblies protrude outwardly from the container side walls. and therefore, are susceptible to being damaged when the container and lid are stored in a confined area. Containers having latch and handle assemblies extending in an upwardly direction from the container also may be subject to storage problems since the handle and latch assembly is the component likely to have the greatest height.

DISCLOSURE OF THE INVENTION

It is thus the primary object of the present invention to provide a container and lid assembly having a handle member which also serves to secure together the container and lid.

It is another object of the present invention to provide a container and lid assembly having a handle and locking member which does not extend substantially beyond the walls of the container and lid.

It is a further object of the present invention to provide a container and lid assembly having a handle and locking member which consists of a minimal number of components and may be easily manufactured and secured to the container.

It is a still further object of the present invention to provide a container and lid assembly having a handle and locking member, which allows for like container and lid assemblies to be stacked when the container and lid are either secured or unsecured.

These and other objects of the present invention, as well as the advantages thereof over existing prior art forms, which will become apparent from the description to follow, are accomplished by the means hereinafter described and claimed.

In general, a container and lid assembly having handle and locking members, pivotally secured to the side walls of the container, may be used to secure together and carry the container and lid. The handle member includes projections which may be pivotably retained within apertures disposed in the container side walls. The handle member may be rotated approximately 180 degrees and thereby occupy two positions, namely an unlocked and a locked position. When the handle member occupies a locked position, the handle member is approximately equal to the height of the lid top wall. When the handle member occupies an unlocked position the handle member is entirely retained in a recess disposed in the container side wall. The orientation of the handle member in both the locked and unlocked positions is such that it does not limit the ability to easily store the container and lid assembly.

A preferred exemplary container and lid assembly incorporating the concepts of the present invention is shown by way of example in the accompanying drawings without attempting to show all the various forms and modifications in which the invention might be embodied, the invention being measured by the appended claims and not by the details of the specification.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
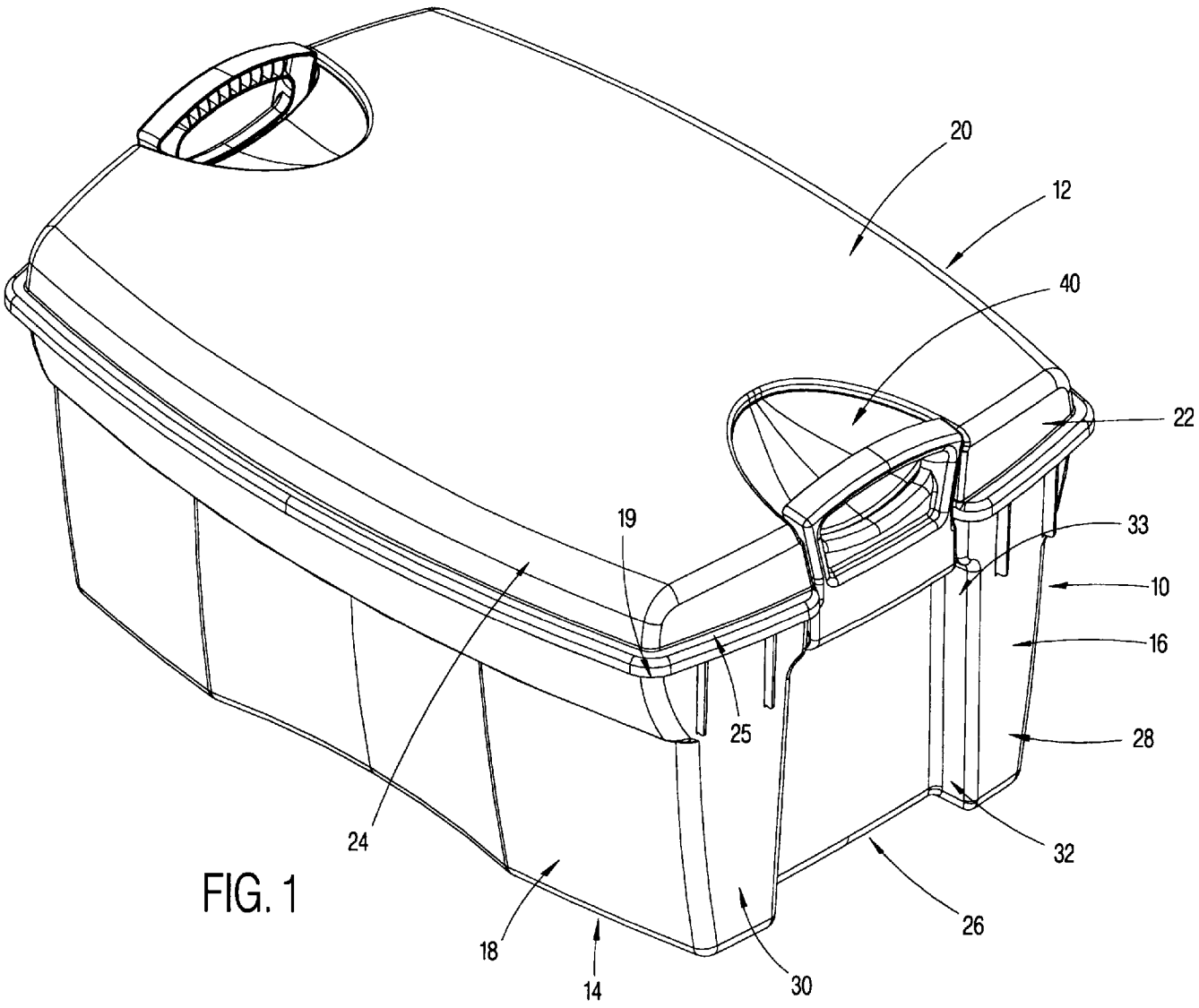
FIG. 1 is a perspective view of the container and lid assembly of this invention showing the container and lid secured together.
Figure 2:
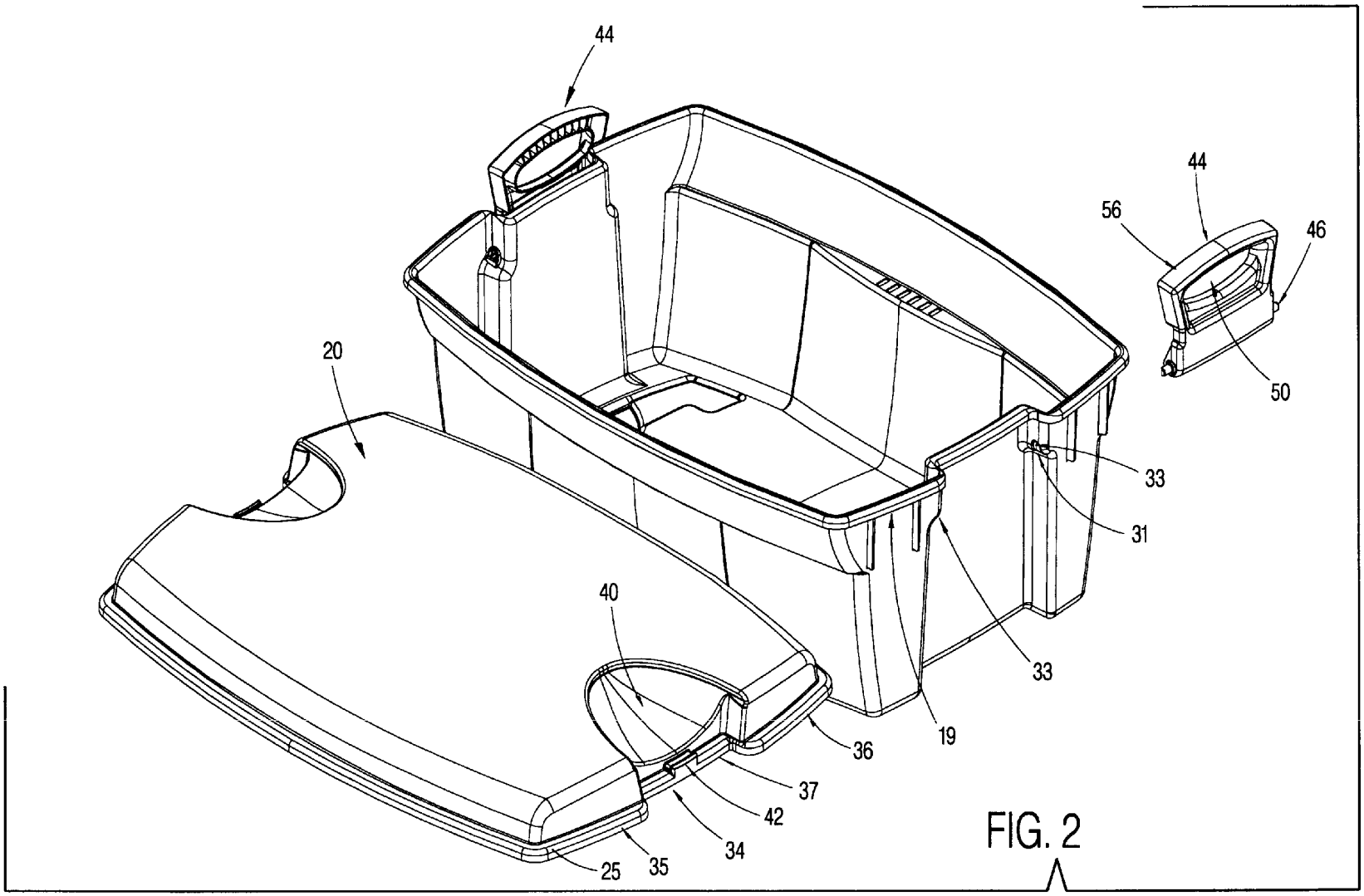
FIG. 2 is a perspective view of the separate components of this invention including the container, lid and handle members.
Figure 3:
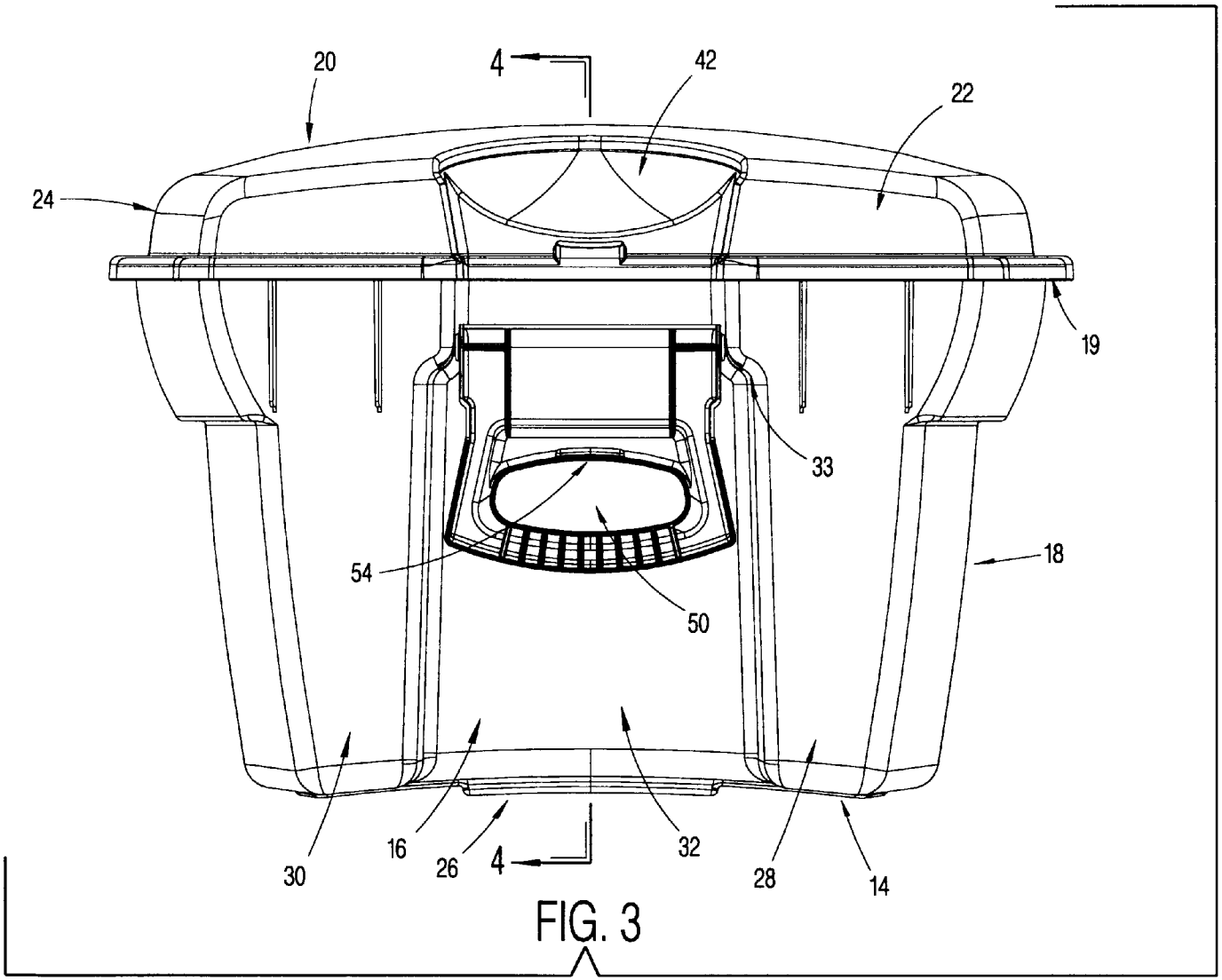
FIG. 3 is a side view of the container and lid assembly illustrating the handle member in an unlocked position such that the lid and container are not secured together.

With reference to the drawings, a container is generally indicated by the numeral 10 in FIG. 1 and includes a lid generally indicated by numeral 12. The container 10 has a bottom wall 14, two side walls 16 and two end walls 18, and the lid 12 has a top wall 20, two side walls 22 and two end walls 24. The end walls 18 may contain air vents as illustrated in FIG. 2 for allowing air to enter the storage container 10 when the lid 12 is placed on top of the container 10. Collars 19 and 25 extend around the perimeter of the container 10 and lid 12, respectively. The container side wall 16 contains a depression 26 disposed within the approximate center of the container side wall 16. such that the container side wall 16 contains spaced apart side wall Surfaces 28 and 30 connected by an intermediary wall 32, as best illustrated in FIGS. 1 and 3. The dimensions of the depression 26 can vary from the upper portion to the lower portion of the depression 26. FIGS. 1–2 clearly illustrate notches 33 disposed within the side wall depression 26. A handle member (discussed later) is pivotably retained in apertures 31 disposed in the notches 33.

The lid side walls 22 also contain a depression 34 defined by spaced apart side walls 35 & 36 connected by an intermediary wall 37. The depressions 26 and 34 disposed within the container 10 and lid 12 respectively, are oriented such that when the lid is located on top of the container 10 the depressions 26 and 34 are aligned. The lid top wall 20 may also contain recesses 40 disposed approximately adjacent the outer edges of lid side wall 22. In the preferred embodiment the recesses 40 are generally U shaped as illustrated in FIGS. 1–3 and generally taper in a downwardly direction towards the lid side wall 22. The recesses 40 may be of various sizes, however in the preferred embodiment the recess 40 is dimensioned such that a user's hand can easily be received and conform to the recess 40. Therefore, in the preferred embodiment the recess 40 extends from the outer edge of the lid side wall 22 in an inwardly direction towards the center of the lid approximately four (4) inches. The open end of the generally U shaped recess 40 is aligned with the depression 34.

A generally upwardly extending finger 42 protrudes from the collar 25 approximately within the center of the lid depression 34. The lowermost portion of the recess 40 is approximately equal to the height of the finger 42, such that the finger 42 and the lowermost edge of the recess 40 form a generally U shaped channel as illustrated in FIG. 4.

Figure 6:
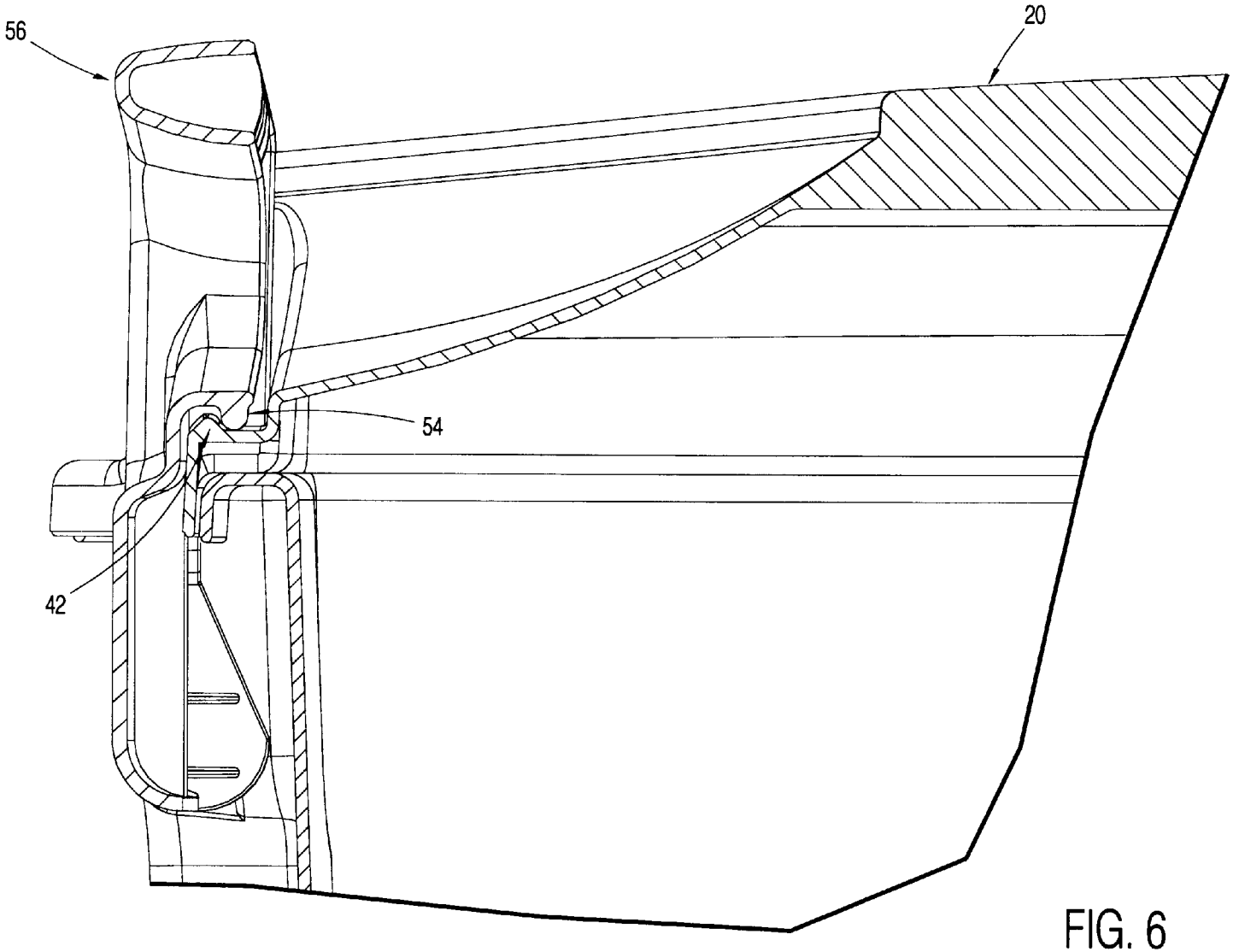
FIG. 6 is a cross sectional view of FIG. 5 along the lines 6—6 illustrating the handle member in a locked position.
Figure 7:
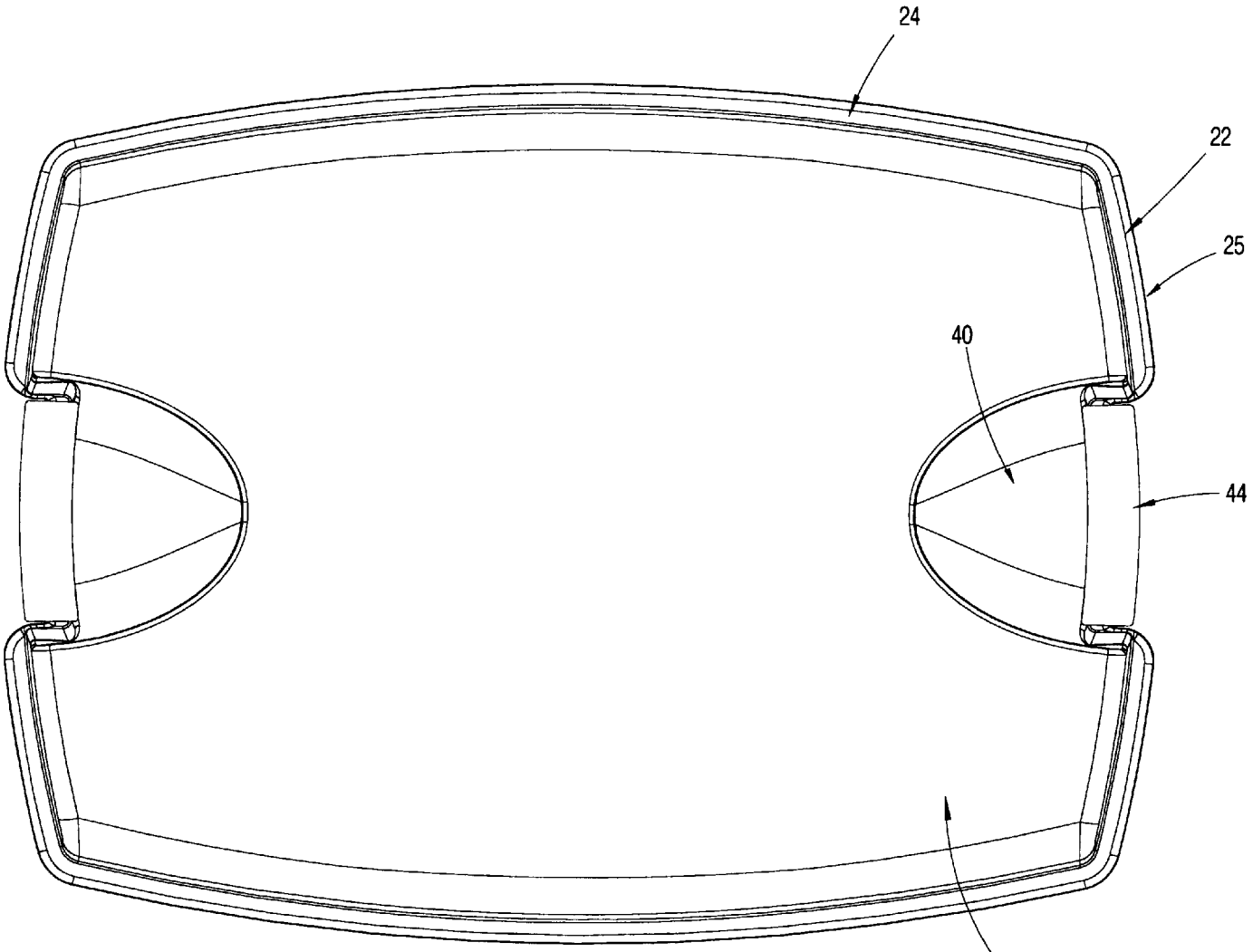
FIG. 7 is a top view of the container and lid assembly.

FIGS. 1–2 illustrate handle members 44 which are easily secured to the container 10, approximately within the center of the depression 26 disposed within the container side wall 16. The handle members 44 each contain projections 46 disposed approximately adjacent to the lower portion of the handle member 44. The projections 46 allow for the handle member 44 to be pivotally retained within the apertures 31, such that the handle member is disposed between the notches 33. An upper portion of the handle member contains a slot 50 for allowing a user's hand to pass through the handle member 44, when the user elects to carry the container 10. The handle member 44 is secured to the container 10 at such an orientation that the handle member 44 can easily be used to carry the container 10 regardless of whether the lid 12 is secured to the container As illustrated in FIGS. 3, 4, and 6 a projection 54 extends in a generally downwardly direction, from the inner wall of the handle member 44, approximately adjacent the slot 50. The projection 54 assists in allowing the securement of the container 10 and lid 12, since projection 54 may be retained by the U shaped channel formed by the finger 42 and the outermost edge of the recess 40.

Figure 4:
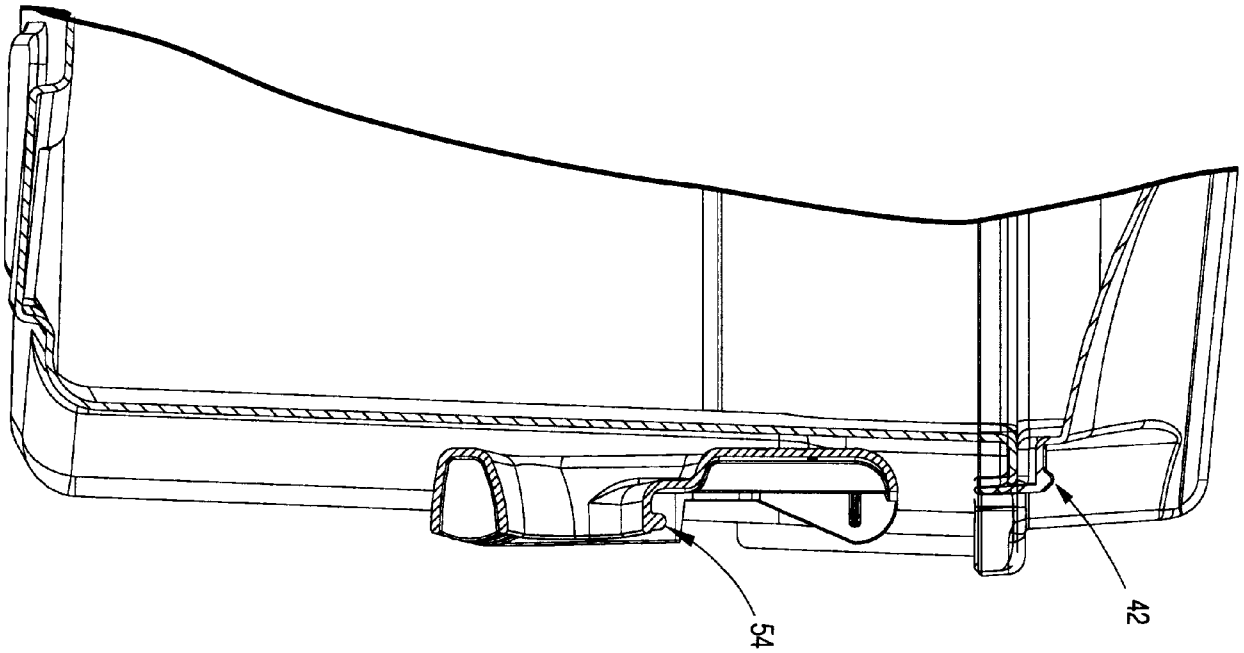
FIG. 4 is a cross sectional view of FIG. 3 along the lines 4—4 illustrating the handle member in an unlocked position.
Figure 5:
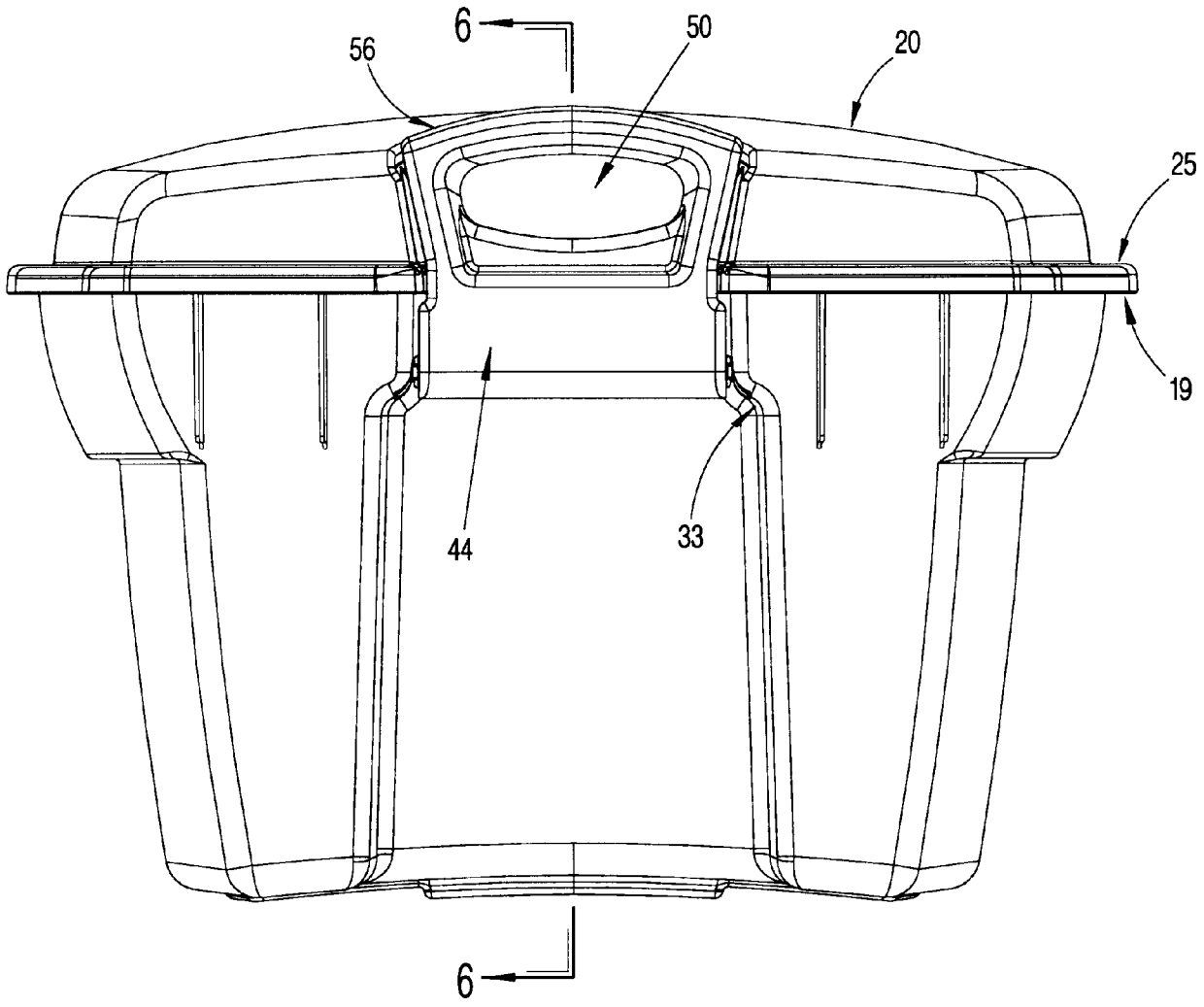
FIG. 5 is a side view of the container and lid assembly of this invention illustrating the handle member in a locked position thereby securing together the container and lid.

In the preferred embodiment the handle member 44 is disposed approximately adjacent to the notches 33 such that the handle member 44 may be entirely received within the depression 26 when the handle member 44 is occupying a first position as illustrated in FIGS. 3–4. When the handle member 44 is occupying the first position as illustrated in FIG. 3, the handle member 44 is pivotally secured to the container 10 such that it does not extend above the container collar 19. Therefore, when the handle member 44 is occupying the first position the handle member 44 is occupying an unlocked position since the container 10 and lid 12 remain unsecured. While the lid 12 and container 10 are not secured. the lid 12 can be used to selectively cover the container 10 without being secured to the container, and therefore, can still be easily removed from the container 10 by lifting the lid 12 in a generally upwardly direction. The handle member 44 may be pivoted in a generally upwardly direction, from the first position as illustrated in FIG. 3 to a second position as illustrated in FIG. 5.

Figure 8:
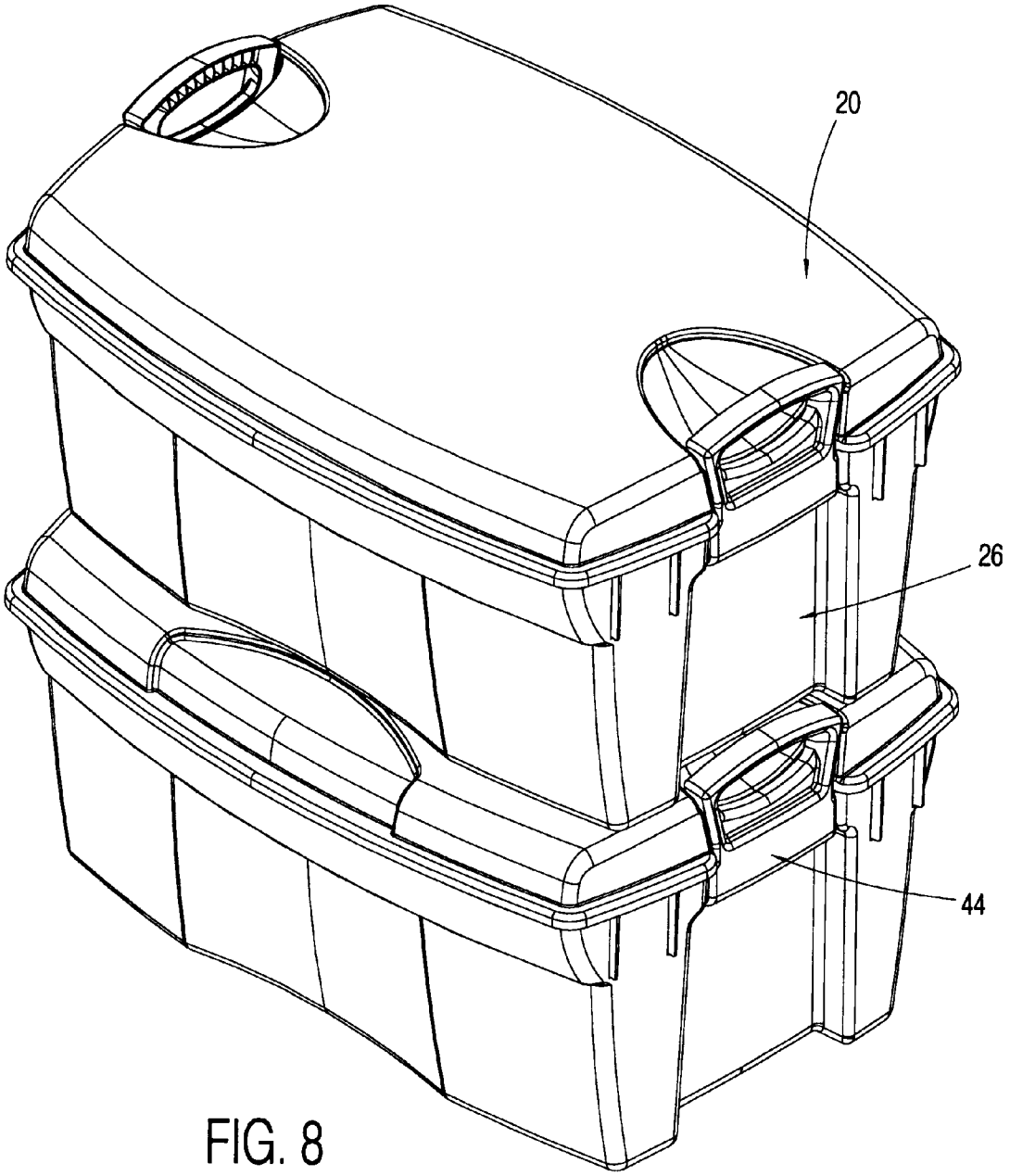
FIG. 8 is a perspective view of a container and lid assembly stacked on top of a like container and lid assembly.

FIG.is. 5–7 illustrate the handle member 44 in a locked position, thereby securing together the container 10 and lid 12. Specifically, the handle member 44 is rotated approximately 180 degrees between the first position illustrated in FIG. 3 and the second position illustrated in FIG. 5. When the handle member 44 is oriented such that slot 50 is aligned with the recess 40 the projection 54 will be approximately adjacent the finger 42. The user should gently push against the handle member such that the projection 54 will flex over the finger 42 and be retained by the U shaped channel defined by the finger 42 and the outermost edge of the recess 40. When the handle member 44 occupies the second locked position as illustrated in FIGS. 5–6, the handle member 44 projects vertically above the uppermost edge of the container 10 to provide a positive grasping surface, as best illustrated in FIGS. 1–6. The uppermost portion 56 of the handle member 44 is approximately equal to the height of the lid top wall 20, as illustrated in FIGS. 1 and 6. Therefore the secured container and lid can be easily stored since the handle member 44 does not extend substantially above the lid top wall 20. Also when a first container having a lid is stacked on top of a second container and lid, a uppermost portion of the handle member 44 of the second container is disposed within the lowermost portion of the depression 26 of the first container, as illustrated in FIG. 8.

To separate a secured container 10 and lid 12, the handle member 44 must be rotated approximately 180 degrees by gently pulling in an outwardly direction on the handle member 44. As the handle member is pulled in a generally outwardly direction, the projection 54 will become disengaged from the U shaped channel, defined by the finger 42 and the outermost edge of the recess 40 and therefore, easily occupy the first position as illustrated in FIG. 3.

It should be appreciated that a container and lid assembly constructed according to the concepts of the present invention, as described herein, accomplishes the objects of the invention and otherwise substantially improves the container and lid assembly art.

I claim:

1. A container and a lid assembly comprising:

said container having sides, a bottom, a first and second end, and an open and unobstructed top, and a first handle and a second handle disposed adjacent said container first end and said second end, said container including a depression disposed within an approximate center of each of said side walls for receiving said handle member when said handle member is disposed in said second unlocked position;

said lid having sides, a top, a first and second end, and a first recess disposed within said top approximately adjacent said lid first end and extending towards a center portion of said lid top; and said first recess and said first handle being oriented such that when said lid is resting on said container an uppermost portion of said first handle is vertically spaced above the first recess and a user grasps said first handle uppermost portion at least a portion of the user's hand may be received in said first recess within said lid top, said uppermost portion being approximately equal to the top of said lid.

2. A container and lid assembly according to claim 1, said lid first recess decreasing in depth as said recess approaches said center portion of said top.

3. A container and lid assembly according to claim 1, said lid further comprising a second recess disposed approximately adjacent said lid second end and extending towards said top center portion.

4. A container and lid assembly according to claim 1, said first handle further comprising locking means for securing together said container and said lid.

5. A container and lid assembly according to claim 3, said first and second recesses being generally U shaped.

6. A container and lid assembly according to claim 4, said first handle being pivotal between a first locked position and a second unlocked position.

7. A container and lid assembly according to claim 4, said locking means further comprising a projection disposed adjacent said first handle for engagement with an indent disposed adjacent said lid first end for locking together said container and said lid.

8. A container and lid assembly according to claim 4, said locking means further comprising a flange protruding in a generally downwardly direction from an inner wall of said first handle for engagement with a detent disposed adjacent said first lid first end.

9. A container and lid assembly comprising:

a container with a bottom wall, front wall, rear wall and two side walls, handle means, disposed adjacent each of said side walls, for carrying and locking together said container and a lid having a top wall, two side walls and two end walls;

each of said handle means further comprising a handle member pivotally secured to said container side wall such that said handle member is pivotal between a first locked position and a second unlocked position, said handle member having an uppermost portion;

said handle member further comprising a flange which may be received in a detent disposed adjacent said lid side wall for locking together said lid and said container;

said container further comprising a depression disposed within an approximate center of each of said side walls for receiving said handle member when said handle member is disposed in said second unlocked position;

said assembly further comprising a depression disposed within an approximate center of each of said lid side walls; and a recess disposed within said lid top wall approximately adjacent each of said lid side walls extending towards a center of said lid top wall from each of said lid side walls such that when said handle member is in said first locked position said uppermost portion is vertically spaced above the recess and approximately equal to the top wall of the lid.

10. A container and lid assembly according to claim 9, wherein said recess increases in depth from a closed end to an open end of said recess.

11. A container and lid assembly according to claim 9, said handle member further comprising an outer wall and an inner wall, said handle outer wall being approximately flush with said container side wall and lid side wall when said handle member is disposed in said first locked position and said handle inner wall being approximately flush with said container side wall when said handle member is disposed in said second unlocked position.

12. A container and lid assembly comprising:

a base member having opposed end and side walls integrally connected to a bottom wall, and an first and a second handle member pivotally secured to each of said side walls between a first locked position and a second unlocked position, said base member further comprising a depression disposed within an approximate center of each of said side walls for receiving said handle member when said handle member is disposed in said second unlocked position; and a lid member having opposed end and side walls integrally connected to a top wall, two recesses extending towards said lid side walls; and locking means for allowing said handle members to pivot between said first locked position in which an uppermost portion of said first and said second handle members is vertically spaced above a respective one of said lid member top wall recesses and approximately equal to the top wall of the lid, and said second unlocked position.

13. A container assembly according to claim 12, said locking means further comprising a flange disposed adjacent said handle members for engaging an indent disposed adjacent said lid side wall.

14. A container and lid assembly according to claim 13, said flange disposed approximately adjacent to a slot of said handle member, said slot for allowing a user's hand to pass through said handle member.

15. A container and lid assembly according to claim 12, wherein said container side walls are provided with a recess, said handle members being received within said recess.

16. A container and lid assembly according to claim 14, wherein the handle uppermost portions are spaced above the lid member top wall recesses a distance to allow a user's hand to enter the top wall recess and simultaneously grasp a handle uppermost portion thereover after the user's hand passes through said handle member slot.

* * * * *